United States Patent [19]

Schumacher et al.

[11] 4,001,487

[45] Jan. 4, 1977

[54] SYSTEM FOR SUPPLYING CURRENT TO A GROUP OF HIGH-CURRENT RESISTANCE FURNACES THROUGH A PLURALITY OF TRANSFORMERS

[75] Inventors: Otto Schumacher, Biberbach; Hans Jonas, Gersthofen, both of Germany

[73] Assignee: Sigri Elektrographit GmbH, Augsburg, Germany

[22] Filed: July 1, 1975

[21] Appl. No.: 592,217

[30] Foreign Application Priority Data

Aug. 13, 1974 Germany ..... 2438742

[52] U.S. Cl. ..... 13/24; 13/23

[51] Int. Cl.[2] ..... F27D 11/04

[58] Field of Search ..... 13/20, 23, 24, 25

[56] References Cited

UNITED STATES PATENTS 2,911,542 11/1959 Hoffstätter ..... 13/24

*Primary Examiner*—R. N. Envall, Jr.

*Attorney, Agent, or Firm*—Herbert L. Lerner

[57] ABSTRACT

System for supplying current to a group of high-current resistance furnaces including a plurality of transformers switchingly connectible sequentially to the individual furnaces singly and together in parallel, the group of furnaces being subdivided into two subgroups of furnaces, each having one of said transformers associated therewith, and including a third transformer selectively switchingly connectible in parallel to the one and the other of the two subgroups of furnaces.

5 Claims, 4 Drawing Figures

SYSTEM FOR SUPPLYING CURRENT TO A GROUP OF HIGH-CURRENT RESISTANCE FURNACES THROUGH A PLURALITY OF TRANSFORMERS

The invention relates to a system of supplying current to a group of high-current resistance furnaces through a plurality of transformers sequentially connectible individually and together in a parallel connection to the individual furnaces.

High-current resistance furnaces serve especially for producing graphite and silicon carbide, the respective material used being heated to temperatures of about 2500° to 3000° C by a current of relatively high strength passing directly therethrough. Depending upon the size of the furnace, one to three days are required for heating the furnace while the cooling period therefor is about 4 to 14 days. Including servicing or preparing and emptying of the furnace, the entire furnace cycle takes about 6 to 19 days. The heating-up period is subdivided into a start-up stage, in which very slight power or energy is required, and a second stage requiring high power or energy, the so-called final drive. Since the current supply equipment in the first stage is used to only a limited extent, it is obvious to employ, besides the main transformer which is constructed or designed to provide the aforementioned final drive, an auxiliary or advance transformer which yields a current strength and power which corresponds to the requirements or conditions for the start-up stage. If a plurality of high-current resistance furnaces are combined into a furnace group, the main transformer and the auxiliary or advance transformer can be used simultaneously for the final drive of one furnace and for starting-up the heating of a succeeding furnace of the group, respectively. If the furnace group has eight furnaces, for example, the current supply equipment is virtually continuously in use substantially at the rated power or output thereof. This type of operation is referred to hereinafter as booster operation.

If the booster operation is effected with stationary transformers located adjacent the furnace group, respective high-current bus bars or contact rails are required both for the main transformer as well as for the advance or auxiliary transformer for connecting the transformers to the furnaces, resulting in a great expense for high-current bus bars and high-current switches. When using a movable or traveling main transformer with a movable or traveling advance or auxiliary transformer it is, on the other hand, impossible to effect a booster operation also at the end furnaces of a group thereof arranged in a row, because the travel of the advance or auxiliary transformer on the common track, which it shares with the traveling main transformer, is blocked by the latter when the latter is connected to the last furnace. Without additional costly features, such as a second track for example, this disadvantage cannot be eliminated. If the main transformer should eventually become inoperative, the operation then comes to a complete halt.

It has become known heretofore from German Pat. No. 1,204,760 to coordinate a plurality of transformers of equal power output to a group of high-current resistance furnaces and to switchingly connect a single transformer and a plurality of transformers in parallel sequentially to the individual furnaces. In a system having three transformers, for example, the first transformer energizes a high-current resistance furnace located at one end of the row of furnaces and starts to heat it up. The second and third transformers and simultaneously switchingly connected in parallel with an adjacent furnace of the group of furnaces and drive the temperature of the last-mentioned furnace up to the desired final heating temperature. After the final drive has ended and the furnace has reached its final temperature, the second transformer shifts parallel to the first transformer so that both of those transformers energize the furnace located in the one end position of the row of furnaces for finally driving the temperature thereof up to the desired high temperature, while the third transformer is caused to travel to the other end furnace in order to start heating the other end furnace up. This booster operation affords an improved utilization of the capacity of the furnace installation and is moreover less sensitive to disturbances, because operation with reduced capacity remains possible if one of the transformers should become inoperative. A further advantage is provided from the possibility of using relatively smaller current supply equipment even for furnaces of relatively larger dimensions and therewith having relatively larger service or connecting lines.

On the other hand, this heretofore known system of German Pat. No. 1,204,760 which affords an improved booster operation, requires a greater technical outlay or cost and is, in addition, relatively susceptible to disruption under rough operating conditions, such as, for example, a graphitizing installation or plant. Thus, for example, the space provided for receiving the drivable or traveling transformers extends along the entire length of the row of furnaces and, due to the traveling of the transformers during a change to a new furnace unit, a time loss unavoidably occurs which reduces the period of utilization of the system. All necessary connections to the furnace units must additionally be formed anew every time by means of electrical conductor lines, switches and hoses before each travel of the transformers along the furnaces, wear of the connecting members being thereby increased and disruptions and disturbances due to improperly formed connections being unavoidable.

If direct current is employed eventually for supplying the high-current resistance furnaces, each transformer being combined with a rectifier device into a traveling or mobile transformer-rectifier unit, the mobility compels compromises with respect to the construction of the units, due to which, especially, efficiency, operational reliability and also capital expenditure are undesirably affected. Due to the mobility of the transformer-rectifier units, the maximal power output thereof is additionally reduced, the lower power output being unable to be compensated for through connection in parallel of more than two units for one furnace without having to enlarge the spacing between the furnaces disadvantageously.

it is accordingly an object of the invention to provide a system for supplying current to a group of high-current resistance furnaces through a plurality of transformers which is an improvement over the corresponding system of German Pat. No. 1,204,760 and which, especially, affords a realization of the advantages of booster operation without having to take into consideration the foregoing disadvantages of the heretofore known system of the German patent.

With the foregoing and other objects in view, there is provided in accordance with the invention, a system for supplying current to a group of high-current resistance furnaces which comprises a plurality of transformers switchingly connectible sequentially to the individual furnaces singly and together in parallel, the group of furnaces being subdivided into two subgroups of furnaces, each having one of the transformers associated therewith, and including a third transformer selectively switchingly connectible in parallel to the one and the other of the two subgroups of furnaces.

In accordance with another feature of the invention, a rectifier is connected respectively to each of the transformers so as to form therewith a transformer-rectifier unit.

In accordance with a further feature of the invention, the system includes high-current dividers connected to the furnaces, and high-current conductor rails for connecting the transformer-rectifier units to the high-current dividers, the high-current dividers being dimensioned for accommodating half the rated maximal furnace current.

Other features which are considered as characteristic for the invention are set forth in the appended claims.

Although the invention is illustrated and described herein as embodied in a system for supplying current to a group of high-current resistance furnaces through a plurality of transformers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
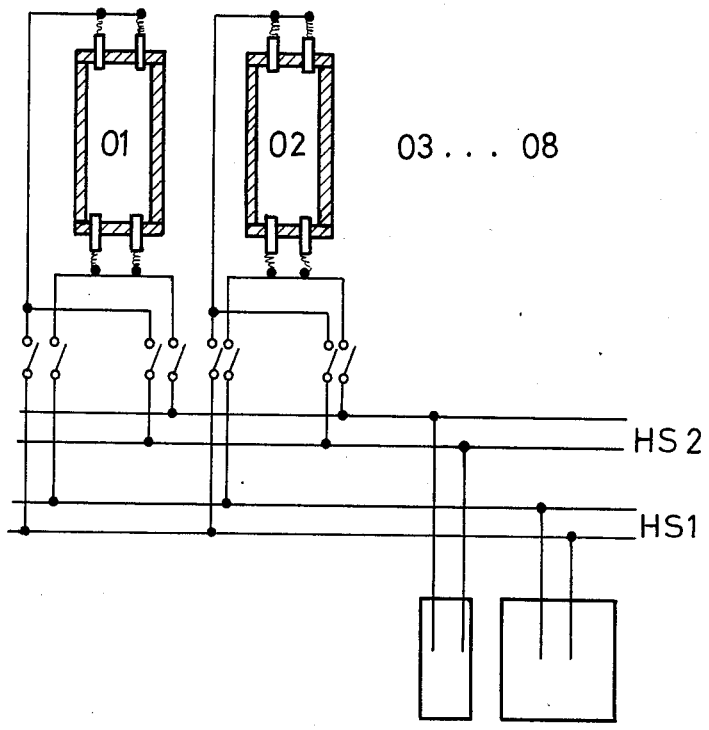
Fig. 1 PRIOR ART
FIG. 1 is a diagrammatic view of a heretofore known system for booster operation having stationary transformers.

Referring now to the drawings and first, particularly, to FIG. 1 thereof, there is shown therein in diagrammatic view a heretofore known system for supplying current to a group of eight high-current resistance furnaces 01 to 08 through a main transformer HT and an auxiliary or advance transformer VT fixedly disposed adjacent the group of furnaces 01 to 08 and connected to high-current contact rails or bus bars HS 1 and HS 2, respectively. The high voltage side of the transformers and the connection thereof to a high voltage source is not shown in FIG. 1 nor in the succeeding figures but is, nevertheless, readily apparent to any man of ordinary skill in the art.

The main transformer HT energizes the furnace 01, for example, through the high-current bus bars HS 1 and drives the temperature thereof up to the desired final temperature, while the advance or auxiliary transformer VT is connected to the furnace 02 through the bus bars HS 2 and begins to heat up the furnace 02. After the final heating temperature of the furnace 01 has been attained, the main transformer HT is connected to the furnace 02, and the auxiliary transformer VT to the furnace 03, and the foregoing operation is repeated. By further repetition of this operation, all of the eight furnaces 01 to 08 are thus heated up to the desired temperature.

Figure 2:
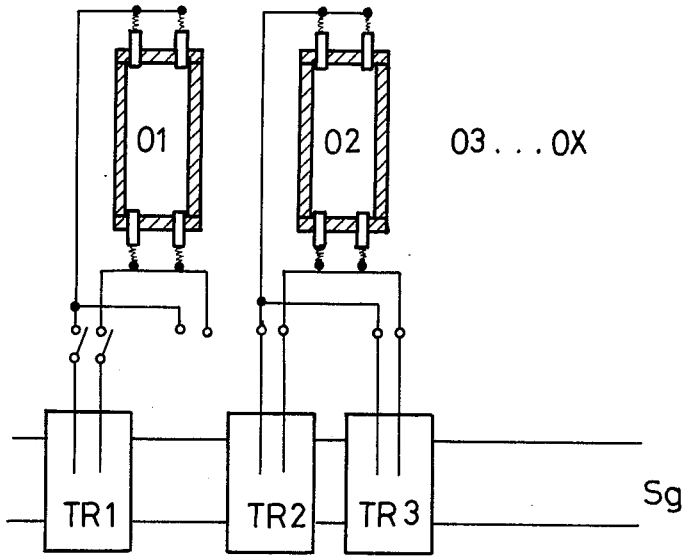
Fig. 2 PRIOR ART
FIG. 2 is a view similar to that of FIG. 1 of another system of the prior art having mobile transformers.

In FIG. 2 there is shown a system for a booster operation according to the prior art wherein three mobile or drivable transformers TR1, TR2 and TR3 are mounted displaceably on a railway track Sg. The transformers TR1, for example, energizes the furnace 01 and starts up the heating thereof. The transformers TR2 and TR3 which are connected in parallel one with the other, are, in turn, switchingly connected to the furnace 02 and heat the latter furnace 02 to a desired final temperature. After the desired final temperature has been attained, the transformer TR2 and the transformer TR3 are driven, respectively to the furnace 01 and to the furnace OX at the other end of the row of furnaces and, after the transformers TR2 and TR3 have been suitably switchingly connected to the furnaces 01 and OX, respectively, the heating or drive to the final temperature begins for the furnace 01 and the start-up of heating for the furnace OX.

Figure 3:
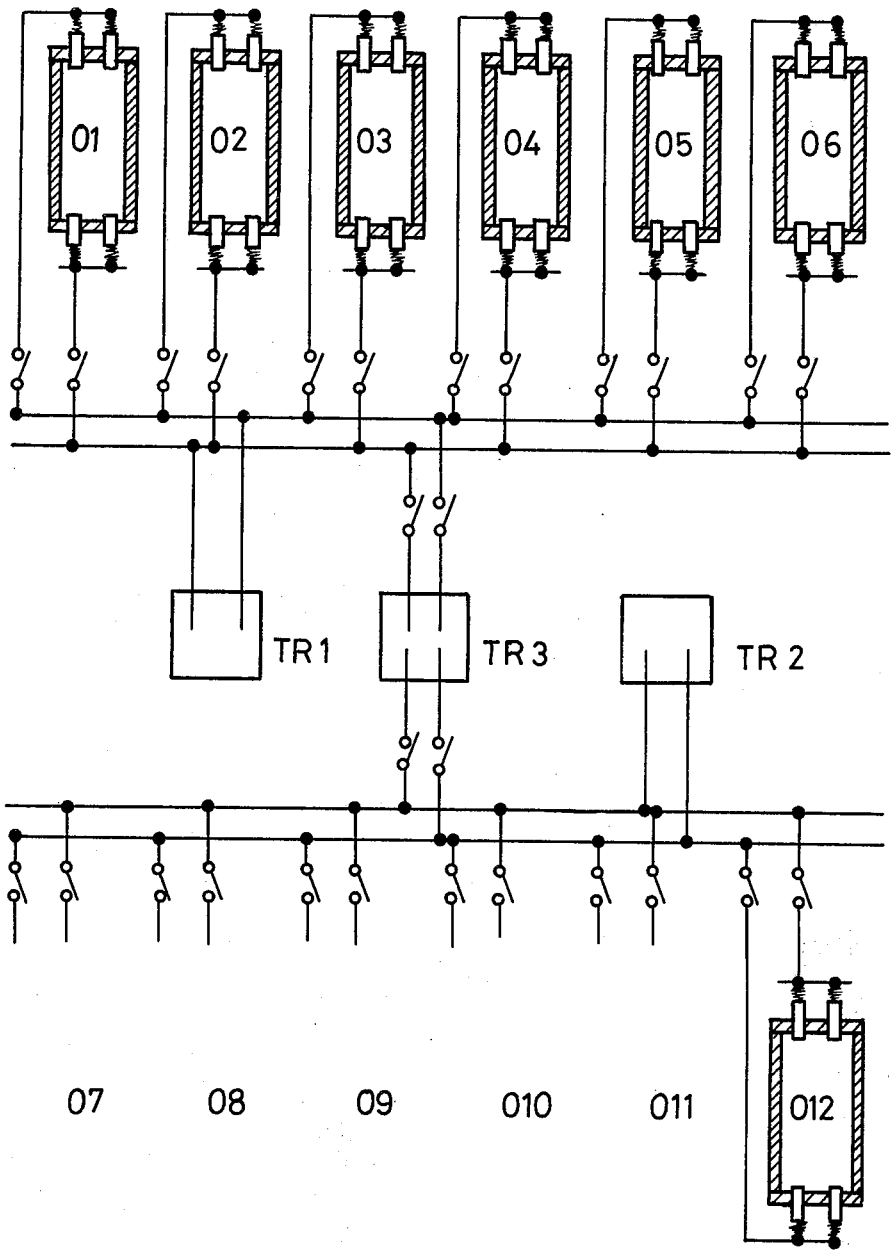
FIG. 3 is a diagrammatic view of the improved system according to the invention which is energized by alternating current.

In the embodiment of the system of the invention illustrated in FIG. 3, there is provided a group of twelve high-current resistance furnaces 01 to 012, which is divided into two subgroups each consisting of six furnaces. The transformer TR1 is stationary and switchingly connectible to the subgroup 01 to 06, and the transformer TR2 is also stationary, however, it is switchingly connectible to the subgroup 07 to 012. The transformer TR3 is selectively switchingly connectible in sequence both to the subgroup 01 to 06 as well as to the subgroup 07 to 012, due to which, when the transformers TR1, TR2 and TR3 that are used have the same power output, the power available at the respective furnaces will be doubled, and adequate power is available for the start-up and the final drive.

The transformer TR1, for example, feeds the furnace 01 of the one subgroup through a high-current divider, shown at the ends of the furnace, and starts up the heating of the furnace 01. At the same time the furnace 07 of the other subgroup is heated up highly to the desired final temperature therefor by both parallel-connected transformers TR2 and TR3. After completion of the final drive to the final temperature, the transformer TR3 is switched over to the furnace 01 and the latter furnace 01 is then driven up to the final temperature that is desired. The transformer TR2 is simultaneously switched to the furnace 08 to begin the start-up heting period for the latter furnace 08. In each case, respectively, one furnace of both subgroups is being heated up, alternatingly, one furnace of one of the subgroups being energized by one transformer, and one furnace of the other of the subgroups being energized by two transformers.

Figure 4:
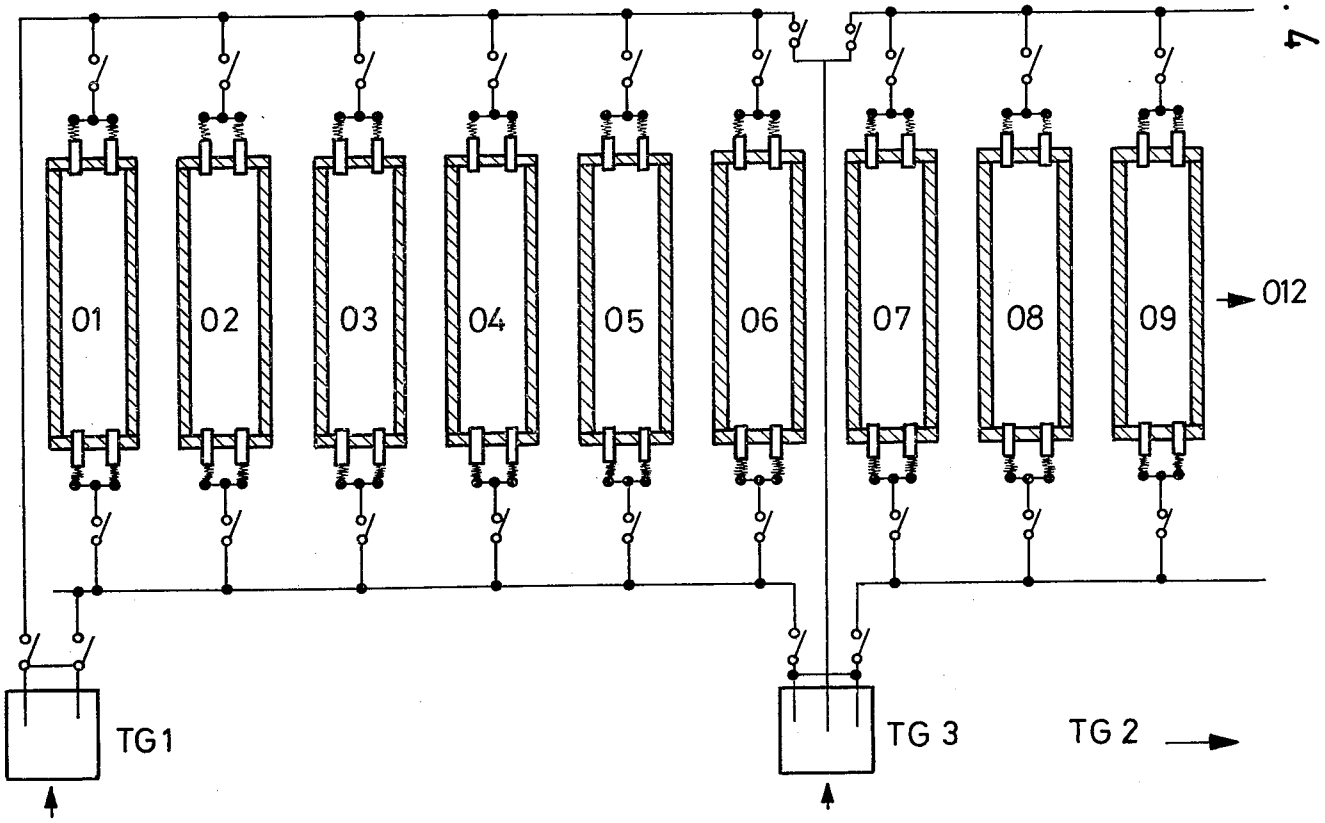
FIG. 4 is a view similar to that of FIG. 3 of another embodiment of the system according to the invention, which is energized by direct current.

In the embodiment of the system of the invention shown in FIG. 4, two subgroups of high-current resistance furnaces disposed in respective rows of six furnaces each are provided. Transformer-rectifier units TG1 and TG2 of conventional construction are fixedly mounted in association with the respective subgroups 01 to 06 and 07 to 012 and are connectible therewith by suitable switches such as is shown with respect to the unit TG1 at the lefthand side of FIG. 4. A conventional transformer-rectifier unit TG3, also stationary with respect to the subgroups 01 to 06 and 07 to 012, is selectively switchingly connectible in sequence i.e. one after the other subgroup. The operation of the embodiment of the system according to the invention shown in FIG. 4 occurs in a manner similar to the operation of the embodiment aforedescribed and illustrated in FIG. 3. The high-current conductors or bus bars between the transformer-rectifier units and the high-current dividers located at the ends of the respective furnaces are constructed, respectively, for carrying half the maximal furnace current. The subgroups are mutually connected by non-illustrated connecting conductors or bars which permit the operation of the system of the invention to be maintained if one or more of the transformers or rectifiers were to become inoperative.

Thus, the system of the invention requires only one high-current bus bar system serving both for start up as well as for final heating drive, as compared, to the heretofore-known booster operation with stationary transformers, and accordingly requires less high-current bus-bars or conductor rails per se as well as less high-current switching devices. The stationary construction of the transformer or the transformer-rectifier units according to the invention as shown, respectively, in FIGS. 3 and 4 affords an optimal construction of the system of the invention with respect to efficiency and operational reliability, when compared to the booster operation with mobile transformers or mobile transformer-rectifier units of the corresponding prior art systems. Moreover, the high-voltage bus-bar system as well as the hall or elongated chamber for the transformers, which extend along the entire length of the row of furnaces, are thus dispensed with. The cost of high-current bus-bars can also be reduced when using transformer-rectifier units, because the bus-bars or conductor rails are constructed in accordance with a feature of the invention, only for half the maximal current to the furnace, respectively. The effective period of utilization of the system according to the invention is additionally increased due to the omission of the down time or ineffective time resulting from the time period required for travel and connection of the mobile transformers as well as due to the limited susceptibility to disruption or breakdown resulting from the limited number of continually and repeatedly releasable connecting elements.

It is claimed:

1. System for supplying current to a group of high-current resistance furnaces which comprises a number of transformers switchingly connectible in sequence individually and in a plurality thereof in parallel to selective furnaces of the group thereof, the group of furnaces being subdivided into two subgroups of furnaces, each of said subgroups having one of said transformers associated therewith, and said number of transformers including a third transformer selectively switchingly connectible in parallel to the one and the other of the two subgroups of furnaces.

2. System according to claim 1 wherein a rectifier is connected respectively to each of said transformers so as to form therewith a transformer-rectifier unit.

3. System according to claim 2 including high-current dividers connected to said furnaces, and high-current conductor rails for connecting said transformer-rectifier units to said high-current dividers, said high-current dividers being dimensioned for accommodating half the rated maximal furnace current.

4. System according to claim 1 wherein said transformers are stationary relative to said furnaces.

5. System according to claim 1 wherein the one transformer associated with a respective one of said two subgroups of furnaces is initially connectible to said respective subgroup of furnaces, and said third transformer is thereafter connectible together with said one transformer in parallel with said respective subgroup.

* * * * *